United States Patent [19]

Albrecht

[11] Patent Number: 5,040,794

[45] Date of Patent: Aug. 20, 1991

[54] REMOVABLE PLAYER PIECE ACTUATOR FOR A SLOTTED TABLE TOP GAME

[76] Inventor: Harold S. Albrecht, 250 The Esplanade, Suite 304, Toronto, Ontario, Canada, M5A 1J2

[21] Appl. No.: 518,498

[22] Filed: May 2, 1990

[51] Int. Cl.[5] ..... A63F 7/06

[52] U.S. Cl. ..... 273/85 B; 273/129 R

[58] Field of Search ..... 273/85 R-F, 273/119 R, 119 A, 129 R, 129 V, 129 W; 403/290, 313

[56] References Cited

U.S. PATENT DOCUMENTS

| | | | |
|---|---|---|---|
| 3,586,327 | 6/1971 | Hjelmquist | 273/85 B |
| 3,811,674 | 5/1974 | Trbovich et al. | 273/85 B X |
| 3,856,303 | 12/1974 | Payne et al. | 273/85 B |
| 3,912,269 | 10/1975 | Barlow | 273/85 B |
| 3,913,913 | 10/1975 | Trbovich et al. | 273/85 B X |
| 3,924,854 | 12/1975 | Hjelmquist | 273/85 B |
| 4,042,239 | 8/1977 | Cecchetti | 273/85 F |
| 4,304,405 | 12/1981 | Laine | 273/85 B |
| 4,691,921 | 9/1987 | Iseki | 273/85 B |

FOREIGN PATENT DOCUMENTS

| | | | |
|---|---|---|---|
| 140045 | 1/1951 | Australia | 273/85 F |
| 632459 | 12/1961 | Canada | 273/85 B |
| 632798 | 12/1961 | Canada | 273/85 B |
| 867385 | 9/1981 | U.S.S.R. | 273/85 B |
| 373176 | 5/1932 | United Kingdom | 273/85 F |

*Primary Examiner*—Edward M. Coven
*Assistant Examiner*—Sebastiano Passaniti
*Attorney, Agent, or Firm*—Sim & McBurney

[57] ABSTRACT

A removable player piece actuator for a slotted table game comprising a carriage for sliding along a slot of a slotted table game, the carriage having player piece supporting means, a neck for reception by a slot of the slotted table game; a wing supported by the neck and extending transversely of the neck having a transverse length greater than the width of the slot and having a transverse width less than the width of the slot; and a clamp for releasably retaining a player piece actuating rod; and a player piece actuating rod having a first and second end for reception by the clamp of the carriage proximate the first end and for reception in a side panel of a slotted table game, wherein the clamp comprises a resilient gapped tube sized to receive the player piece actuating rod whereby the player piece actuating rod may be snapped into the tube through the gap, wherein the tube of the carriage has an external radially extending ridge and wherein the player piece actuating rod carries a snap ring which is actually slidable on the player piece actuating rod so that after the player piece actuating rod has been snapped into the tube, the snap ring may be snapped onto the ridge in order to lock the player piece actuating rod within the gapped tube.

13 Claims, 2 Drawing Sheets

REMOVABLE PLAYER PIECE ACTUATOR FOR A SLOTTED TABLE TOP GAME

Figure 1:
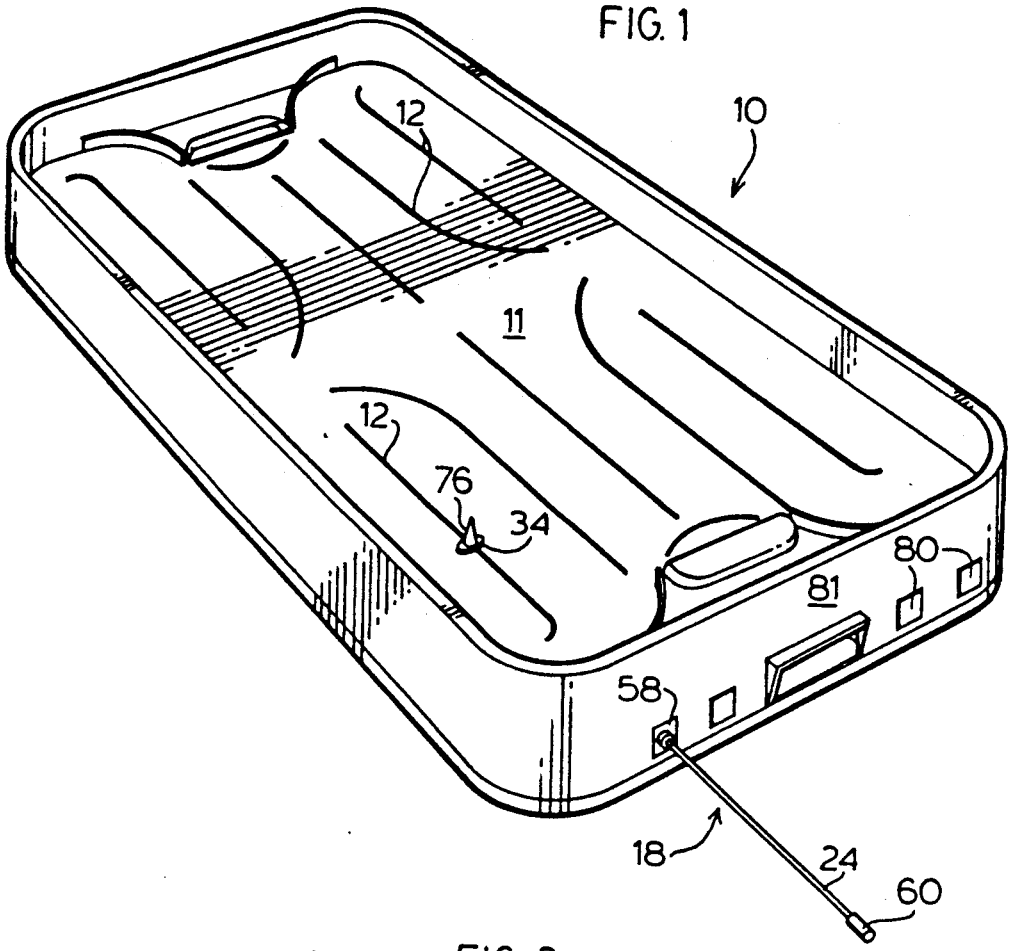

This invention relates to a player piece actuator for a slotted table game which is removable from the game.

Slotted table top games have had a long standing popularity. Key to the operation of such games is a player piece actuator which generally comprises a rod extending horizontally underneath the playing surface of the game terminating at a carriage which slides within a slot of the game. A mechanism is normally provided at the carriage to transmit torques applied to the rod to a vertically directed drivable player piece support which supports a game player piece. The rod passes through the side of the game and terminates at its free end in a knob. Accordingly, the player pieces may be rotated and slid along the slots of the game by twisting, pulling and pushing the rods associated with each player piece.

In the heat of a game, the player piece actuators are subjected to considerable forces as the rods are manipulated with some vigour. These forces may cause an actuator to fail. Since the failure of even one actuator will effectively render the game unusable, techniques have been employed to minimize the risk of failure. One such technique has been to keep the actuator mechanism as simple as possible. In addition, it is known to integrally form the actuator in order to strengthen it. However, despite these approaches, there remains a risk of failure of the actuators.

The subject invention seeks to overcome drawbacks of known player piece actuators for slotted table top games. The philosophy behind the subject invention is in the notion that rather than continue to increase the strength of the player piece actuators, which, no matter how strong, will suffer occasional failure, the actuators may instead be made as replaceable modules.

According to the present invention there is provided a carriage for use in a removable player piece actuator for a slotted table top game, comprising (a) a body; (b) a neck extending from said body for reception by a slot of said slotted table game; (c) a wing supported by said neck and projecting transversely of said neck having a transverse length greater than the width of said slot and having a transverse width less than the width of said slot; and (d) clamp means for releasably retaining a player piece actuating rod whereby said carriage may be oriented so that the transverse width of said wing is parallel to the width dimension of said slot so that said wing may be inserted through said slot whereupon said carriage may be reoriented so that said transverse length of said wing is parallel to the width dimension of said slot so that said neck is received by said slot with said wing resting on the playing surface side of said game, whereupon a player piece actuating rod may be clamped by said clamp means.

In another aspect, there is provided a removable player piece actuator for a slotted table game comprising: (a) a carriage for sliding along a slot of a slotted table game, said carriage having player piece supporting means, a neck for reception by a slot of said slotted table game; a wing supported by said neck and extending transversely of said neck having a transverse length greater than the width of said slot and having a transverse width less than the width of said slot; and clamp means for releasably retaining a player piece actuating rod; and (b) a player piece actuating rod having a first and a second end for reception by said clamp means of said carriage proximate said first end and for reception in a side panel of a slotted table game.

Figure 3:
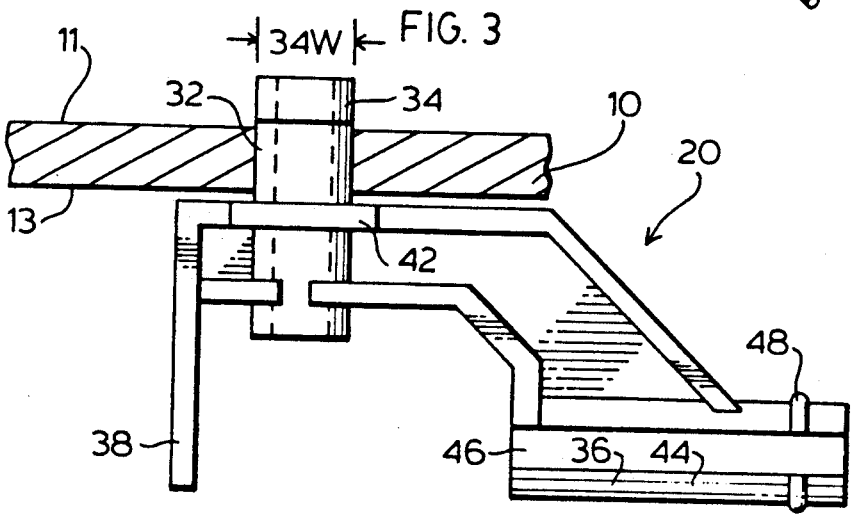
Figure 3A:
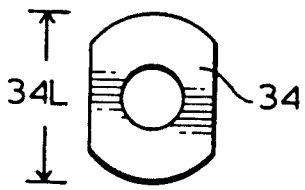
Figure 4:
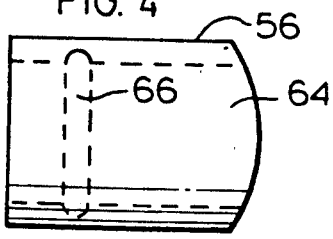
Figure 2:
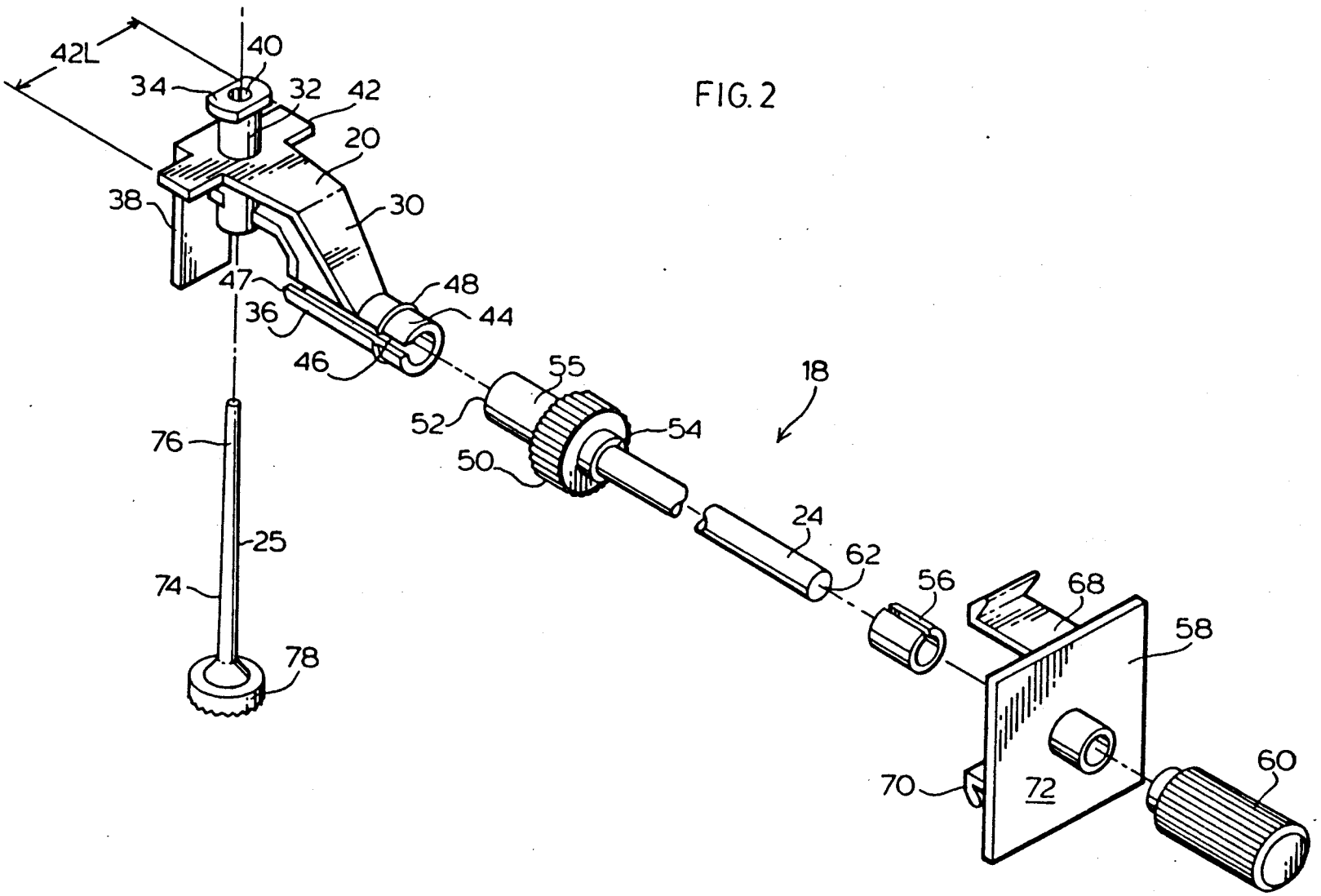

In the FIGS. which describe example embodiments of the invention,

FIG. 1 is a perspective view of a slotted table top game which may utilise the removable player piece actuators of this invention, FIG. 2 is an exploded view of a player piece actuator made in accordance with this invention, FIG. 3 is a side view of a portion of the player piece actuator of FIG. 2 shown in situ, FIG. 3*a* is a top view of a portion of FIG. 3, and FIG. 4 is a side view of another portion of the player piece actuator of FIG. 2.

Turning briefly to FIG. 1, a slotted table top game, which is in the nature of a hockey game, is illustrated at 10. The game has a playing surface 11 containing a number of slots 12. The side of the game 81 has a number of openings 80 each for reception of a snap piece 58 of a player piece actuator 18. The player piece actuator is detailed in FIG. 2 which, by reference to FIG. 2, is seen to comprise a carriage 20, a player piece actuating rod 24 and a drivable player piece support 25.

The carriage 20 has a body 30, a neck 32, an upper wing 34 and a lower wing 42 supported by the neck and extending transversely of the neck, a clamp means 36, a depending leg 38, and a player piece supporting means which comprises an axial opening 40 in neck 32. The upper wing 34 of the carriage has a transverse length 34L (seen in FIG. 3*a*) which is greater than the width of the slots 12 of FIG. 1. Further, this wing has a transverse width 34W (seen in FIG. 3) which is less than the width of the slots 12. The lower wing 42 has a transverse length 42L parallel to the transverse length 34L of the wing 34. Transverse length 42L is also greater than the width dimension of the slots 12. In consequence of this, the carriage 20 may be oriented so that the width dimension 34W of the wing 34 is parallel to the width dimension of a slot 12 whereupon the neck of the carriage may be inserted through the slot 12. Thereafter, the carriage may be reoriented so that the length dimension 34L of the wing 34 and the length dimension 42L of the wing 42 are parallel to the width of the slot 12 so that the neck 32 is retained within the slot 12. This result is seen in FIG. 1 where only wing 34 of the carriage 20 is visible above a slot 12 and is also seen in FIG. 3 wherein a portion of the slotted table top game 10 is shown and it will be noted that wing 34 is positioned on the playing surface side 11 of the game and lower wing 42 is positioned on the opposite side 13 of the game.

Referring to FIGS. 2 and 3, the clamp means 36 of the carriage comprises a resilient tube 44 with a gap 46 extending along one of its sides. The resilient tube 44 has a radially extending ridge 48 which extends about the non-gapped portion of the circumference of the tube. The depending leg 38 of the body 30 of the carriage extends into axial alignment with the gapped tube 44.

The player piece actuating rod 24 supports a gear wheel 50 proximate a first end 52 of the rod. The gear wheel is in the nature of the spur gear. The spur gear has a spacer 55 at the side of the gear proximate the first end 52 of the rod which allows the gear to be positioned a predetermined distance from the end 52 of the rod when the end of the spacer is flush with the end of the rod. An abutment 54 is integrally formed with the spur gear 50 at the side of the spur gear which is distal from the first end 52. A knob 60 is supported at the second end 62 of the rod 24. The rod 24 carries an axially slidable snap ring 56 and an axially slidable snap piece 58 with the snap piece being slidable between the knob and the snap ring and the snap ring being slidable between the snap piece and the abutment 54. As seen in FIG. 4, the snap ring 56 has an axial opening 64 with an annular depression 66 sized to receive the annular ridge 48 of the gapped tube 44. The snap piece comprises oppositely directed resilient snap tags 68 and 70 attached to a face plate 72.

The drivable player piece support 25 comprises a shaft 74 terminating at one end in a player supporting peg 76 and at its other end in a gear wheel 78 which is in the nature of a crown gear.

The player piece actuator of FIGS. 2 through 4 may be assembled in the slotted table game shown in FIG. 1 in the following manner. Carriage 20 is first oriented so that upper wing 34 is directed toward a slot 12 of the game with the width dimension 34W of the wing parallel to the slot. The neck 32 of the carriage may then be inserted in the slot and subsequently the carriage rotated so that the length dimension 34L of the upper wing is parallel to the width dimension of the slot. In this orientation the neck of the carriage is retained within the slot since the length dimension of the upper wing 34L and of the lower wing 42L are parallel to the width of the slot and are of a greater dimension than the width of the slot.

Next the drivable player piece support 25 is inserted in the axial opening 40 of neck 32 until the base of the crown gear abuts the base of neck 32. The player piece supporting peg 76 then projects above the playing surface 11. The player piece activating rod, carrying spur gear 50 with spacer 55 and abutment 54, snap ring 56, snap piece 58, and knob 60 may then be inserted in a side opening 80 of the slotted table top game until end 52 of the rod is adjacent depending leg 38 of the carriage. The portion of the rod adjacent tube 44 may then be pushed into the gap 46 of the resilient tube so that the tube snaps around this portion of the rod whereupon the spur gear with spacer and abutment is positioned between depending leg 38 and end 47 of the resilient tube with the spur gear meshing with the crown gear. Further, the axial freedom of the rod within the resilient tube is restricted to ensure that the spur gear always meshes with the crown gear, as follows: the axial movement of the rod in one direction is limited by end 52 of the rod abutting the depending leg, and in the other direction, by the abutment 54 abutting the end 47 of the resilient tube. The snap ring 56 may then be slid along the rod 24 until it snaps onto the ridge 48 of the tube 36. This locks the rod within the tube 44. The resilient snap tags 68 and 70 of the snap piece may then be pressed into the opening 80 to lock the snap piece in position at the opening 80 whereupon assembly of the player piece actuator is complete and a player piece may be pushed onto the player piece supporting peg 76 of the player piece actuator.

After assembly, pulling on knob 60 will draw the carriage 20 as the abutment 54 of the rod engages the end 47 of the tube of the carriage. Pushing on knob will push the carriage as the end 52 of the rod pushes against depending leg 38 of the carriage. And twisting the rod will rotate the spur gear and hence the crown gear and the player piece supporting peg in order to rotate a player supported by the peg.

If a part of the player piece actuator fails, the actuator may be removed from the game in order to replace the failed part by following the foregoing steps in reverse order. That is, after removing the player from the supporting peg, the snap ring may be snapped off the ridge 48 of the gapped tube and the rod may then be snapped out of the tube 44. This permits the drivable player piece support to drop out of the carriage and the carriage may then be twisted to align the width dimension of the upper wing with the width dimension of the slot so that the carriage may be removed from the slot. Lastly, the free ends of the resilient snap tags may be squeezed together to release these from their grip on the sides of opening 80 so that the snap piece may be pulled away from the opening 80 and the rod 24 slid free of the game.

If desired, slots 12 may be recessed below the playing surface of the game so that the upper wing of each actuator rides in the recess.

I claim:

1. A carriage for use in a removable player piece actuator for a slotted table top game having a playing surface side and an opposite side, comprising:

(a) a body;

(b) a neck extending from said body for reception by a slot of said slotted table game;

(c) a wing supported by said neck and projecting transversely of said neck and having a transverse length greater than the width of said slot and having a transverse width less than the width of said slot;

(d) clamp means for releasably retaining a player piece actuating rod, whereby said carriage may be oriented so that the transverse width of said wing is parallel to the width dimension of said slot so that said wing may be inserted through said slot, whereupon said carriage may be reoriented so that said transverse length of said wing is parallel to the width dimension of said slot so that said neck is received by said slot with said wing resting on the playing surface side of said game, whereupon a player piece actuating rod may be clamped by said clamp means, wherein said clamp means comprises a resilient gapped tube sized to receive said player piece actuating rod, whereby said player piece actuating rod may be snapped into said tube through said gap, wherein said tube has an external radially extending ridge, and further comprising a snap ring having an annular depression sized to receive said external radially extending ridge in order to lock said player piece actuating rod within said gapped tube.

2. The carriage of claim 1 including player piece supporting means comprising an axial opening in said neck for rotatably carrying a drivable player piece support.

3. The carriage of claim 2 including a depending leg extending from said body into axial alignment with said gapped tube for abutting one end of a player piece actuating rod clamped by said gapped tube.

4. The carriage of claim 3 including a lower wing supported by said neck and projecting transversely of said neck spaced from said wing toward said gapped tube and having a transverse dimension parallel to the transverse length of said wing which is of greater dimension than the width of said slot, whereby said neck of said carriage may be received by said slot with said wing on the playing surface side of said game and said lower wing on the opposite side of said game.

5. A removable player piece actuator for a slotted table game comprising:

(a) a carriage for sliding along a slot of said slotted table game, said carriage having player piece supporting means, a neck for reception by said slot of said slotted table game; a wing supported by said neck and extending transversely of said neck having a transverse length greater than the width of said slot and having a transverse width less than the width of said slot; and clamp means for releasably retaining a player piece actuating rod; and (b) said player piece actuating rod having a first and second end for reception by said clamp means of said carriage proximate said first end and for reception in a side panel of said slotted table game, wherein said clamp means of said carriage comprises a resilient gapped tube sized to receive said player piece actuating rod, whereby said player piece actuating rod may be snapped into said tube through said gap, wherein said tube of said carriage has an external radially extending ridge and wherein said player piece actuating rod carries a snap ring which is axially slidable on the player piece actuating rod so that after said player piece actuating rod has been snapped into said tube, said snap ring may be snapped onto said ridge in order to lock said player piece actuating rod within said gapped tube.

6. The removable player piece actuator of claim 5, wherein said player piece supporting means of said carriage comprises an axial opening in said neck.

7. The removable player piece actuator of claim 6 wherein said carriage includes a depending leg extending into axial alignment with said gapped tube for abutting said first end of said player piece actuating rod when said rod is clamped by said gapped tube.

8. The removable player piece actuator of claim 7 including a drivable player piece support comprising a shaft for reception by said axial opening of said neck, said drivable player piece support terminating at an end of said shaft intended to project above the playing surface of said slotted table game in a player supporting peg and said shaft terminating at its other end in a gear wheel.

9. The removable player piece actuator of claim 8 wherein said player piece actuating rod carries a gear wheel proximate said first end, whereby when said drivable player piece support is received by said axial opening of said neck and said player piece actuating rod is clamped by said gapped tube of said carriage, said gear wheel of said player piece actuating rod is positioned between said gapped tube and said depending leg and meshes with said drivable player piece support gear wheel.

10. The removable player piece actuator of claim 9 wherein said player piece actuating rod carries an abutment positioned on the side of said player piece actuating rod gear wheel which is distal from said first end of said rod, said abutment positioned so that when said player piece actuating rod is clamped by said gapped tube proximate said first end and said drivable player piece support is received by said axial opening in said neck, the axial freedom of said player piece actuating rod is restricted by the depending leg of said carriage which limits the axial movement of said first end and by said abutment carried by said player piece actuating rod which abuts against the end of said gapped tube of said carriage, whereby said player actuating rod gear wheel and said drivable player piece support gear wheel are maintained in meshing relation and further, whereby axial forces on said player piece actuating rod may be transmitted to said carriage.

11. The removable player piece actuator of claim 10 wherein said player piece actuating rod carries an axially slidable snap piece positioned between said snap ring and said second end of said player piece actuating rod for snapping into said side panel of said slotted table game.

12. The removable player piece actuator of claim 11 including a lower wing supported by said neck of said carriage and projecting transversely of said neck spaced from said wing toward said gapped tube and having a transverse dimension parallel to the transverse length of said wing which is of greater dimension than the width of said slot, whereby said neck of said carriage may be received by said slot with said wing on the playing surface side of said game and said lower wing on the opposite side of said game.

13. The removable player piece actuator of claim 12 wherein said drivable player piece support gear wheel is a crown gear and wherein said player piece actuator rod gear wheel is a spur gear.

* * * * *